United States Patent [19]

Curtenius

[11] Patent Number: 4,867,702

[45] Date of Patent: Sep. 19, 1989

[54] ELECTRICAL EXTENSION FOR WALL MOUNTING

[75] Inventor: Frederick B. Curtenius, Kalamazoo, Mich.

[73] Assignee: Curtenius Products Company, Augusta, Mich.

[21] Appl. No.: 281,392

[22] Filed: Dec. 8, 1988

[51] Int. Cl.[4] ..... H01R 13/60

[52] U.S. Cl. ..... 439/527; 439/542

[58] Field of Search ..... 439/10, 32, 211, 527, 439/542, 650–652

[56] References Cited

U.S. PATENT DOCUMENTS 2,362,481 11/1944 Hartmann ..... 439/32

4,553,798 11/1985 Murphy ..... 439/32

FOREIGN PATENT DOCUMENTS 170039 1/1960 Sweden ..... 439/650

*Primary Examiner*—Eugene F. Desmond

*Attorney, Agent, or Firm*—Austin A. Webb

[57] ABSTRACT

An elongated casing of U-shaped cross section has a bearing block secured in its upper end. A U-shaped tubular arm has one leg rotatably supported through the bearing block and a female electrical socket on its other arm. Insulated conductors connected to the socket extend through the arm and downwardly through the casing. A spaced block secured in the casing below the pivoted end of the arm has a toggle bolt passed through the front of the casing and between the conductors and projects from the casing to engage a wall and support the casing. An insulating terminal block with conductor plates therein has two contact prongs projecting from the back of the casing at its lower end and two recessed contact holes in its upper face. The block is secured within the casing by bolts passing between the conductor plates. A male connector plug connected to the lower ends of the insulated conductor has its prongs received in the contact holes of the terminal block and in electrical contact with the conductor plates therein. The prongs projecting from the terminal block are spaced to be received in a standard female electrical wall receptacle.

4 Claims, 1 Drawing Sheet

ELECTRICAL EXTENSION FOR WALL MOUNTING

DETAILED DESCRIPTION

Figure 1:
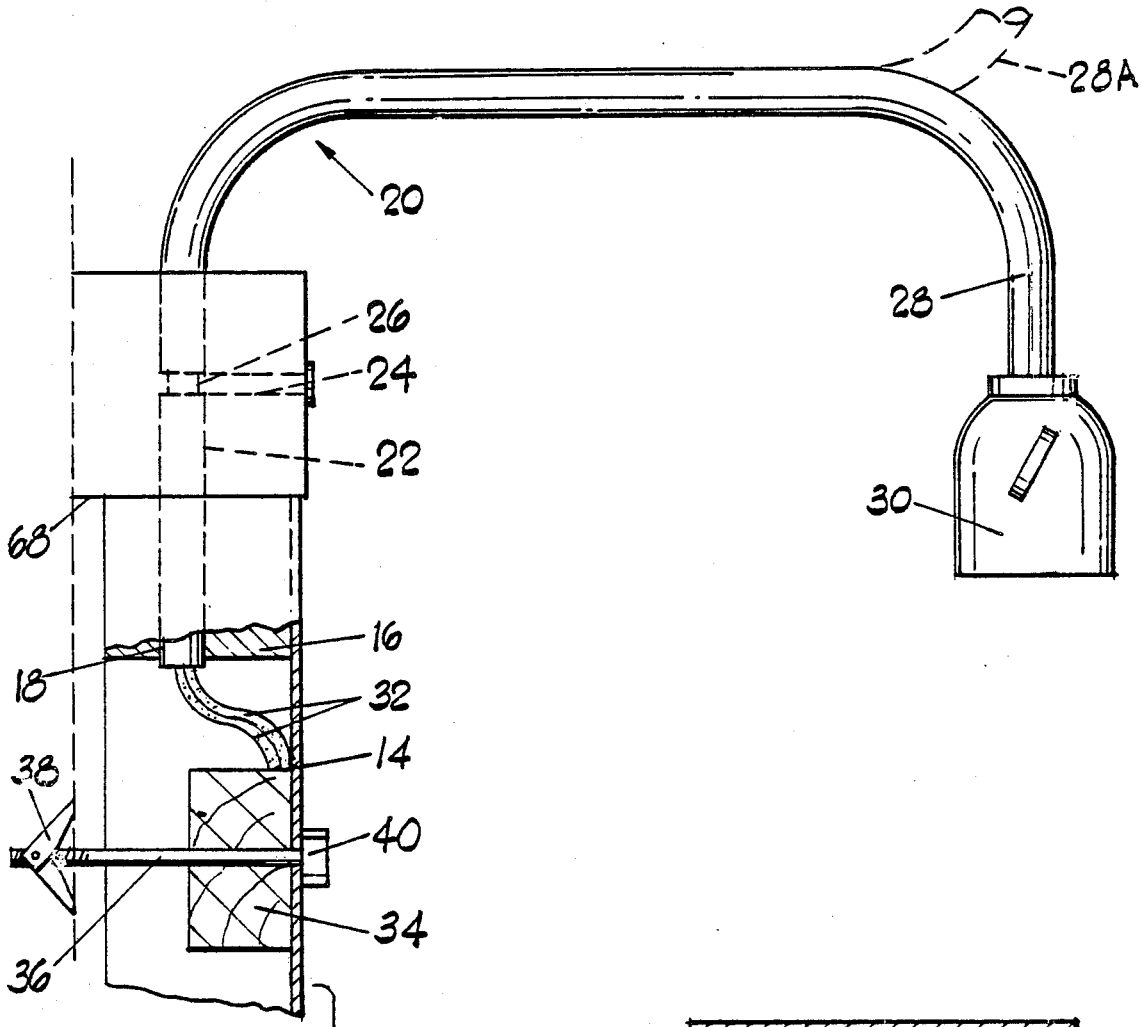
FIG. 1 is a fragmentary side elevational view of the extension of the invention with parts broken away in vertical cross section.
Figure 2:
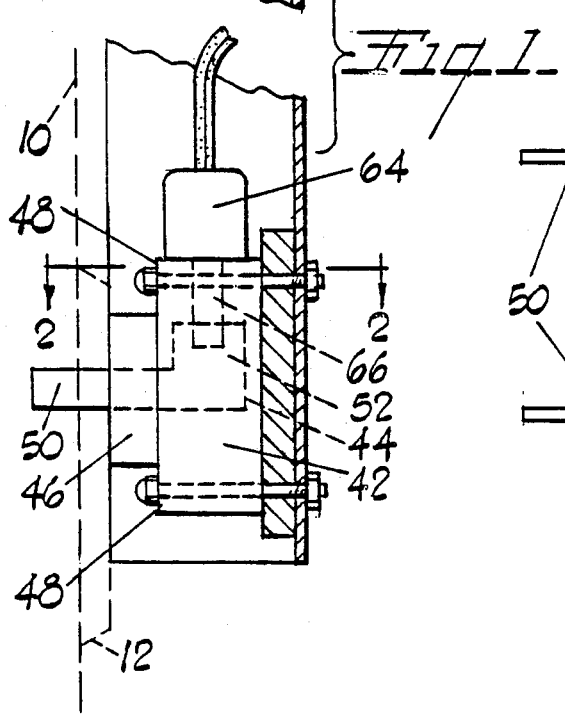
FIG. 2 is a cross sectional view taken along the line 2—2 in FIG. 1 and looking in the direction of the arrows.
Figure 2:
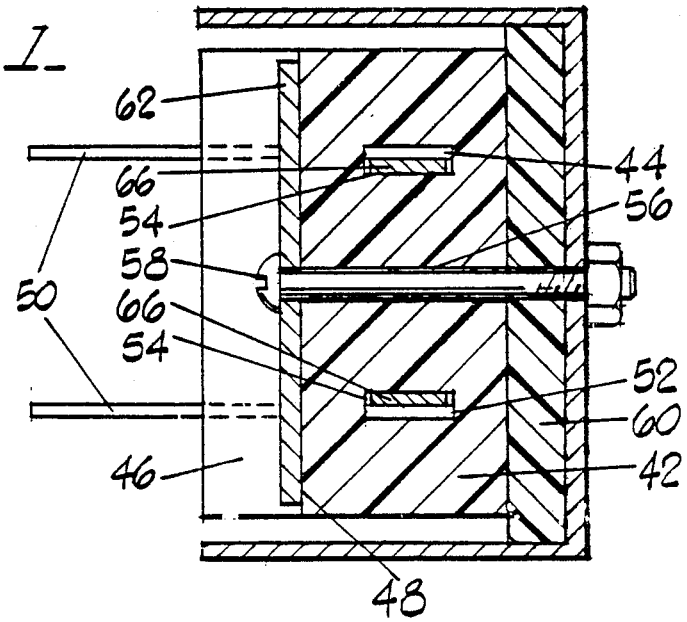

The vertical dotted line 10 indicates the surface of a wall with a standard female electrical outlet 12 near the bottom. The primary part of the extension is an elongated strut 14 of U-shaped cross section. The strut is preferably an aluminum extrusion. Nested into the upper end of the strut, and projecting thereabove is a bearing block 16 with a vertical bore 18 therethrough. A U-shaped tubular arm 20 has a downwardly projecting branch 22 rotatably received in the bore 18. The arm is supported by a pin 24 in the face of the block with its inner end received in an external groove 26 in the tube. The outer swinging end of the arm 20 is turned down as at 28 and connected to a standard electrical socket 30. Alternatively, the outer end of the tube may be turned upwardly as at 28A.

A pair of insulated electrical conductors 32 have their upper ends connected electrically to the socket, and extend therefrom through the tubular arm 20 and downwardly through the recessed back side of the strut 14. Just below the inner end of the block 16 the wires are retained against the inside of the strut by being retained in grooves (not visable) in a wooden block 34. The block 34 and the strut 14 are supported and drawn rearwardly by having the stem 36 of a toggle bolt 38 passed therethrough and engaged through a hole bored through the wall 10. The toggle bolt has a decorative head 40 on the outer, front, side of the strut 14.

Mounted within the lower end of the stut 14 is a terminal block 42 of insulating material having a pair of metal conducting plates 44 embedded therein. The block 42 has a rearwardly projecting neck 46 of somewhat reduced height leaving shoulders 48 on the top and bottom of the block. A pair of prongs 50, one from each conducting plate 44 project rearwardly from the neck 46. Each plate 44 also has an upwardly projecting portion 52 which is exposed within the block 42 at the side of a socket recess 54 opening through the top of the block. The terminal block 42 with its conducting plates 44, prongs 50, and recessed projections 52 is a commercially available item.

The block 42 is adapted to the strut or casing body of the extension fixture of the invention by boring holes 56 through the middle of the block and between the plates 44 and passing bolts 58 through the holes and alined holes in the face of the strut. A spacer strip 60 of insulating material locates the block so that the prongs 50 project from the rear of the strut to engage in the standard electrical outlet 12. Clamping strips 62 of metal distribute the clamping pressure of the bolts 58 over the body of the block 42.

The lower ends of the conductors 32 are connected within the body of a standard male connector plug 64 with prongs 66. The prongs 66 are received in the socket recesses 54 of the connector block in contact with the projections 52 in the block.

It should be noted that the projecting upper end of bearing block 16 at the top of the extension fixture projects rearwardly behind the rear face of the strut 14 as at 68 in FIG. 1 by approximately the same distance as the thickness of the standard outlet fixture 12. This results in the strut being located parallel to the wall when the upper clamping means in the form of the toggle bolt 36 is tightened.

What is claimed to be new and what is desired to be secured by Letters Patent is defined by the following claims:

1. An electrical fixture adapted to be mounted on a wall comprising:

an elongated strut defining an elongated recess along its rear side, a tubular bracket of angular shape having one arm rotatably supported in the upper end of said strut and projecting thereabove with a laterally projecting arm on its upper end, a female electrical socket on the swinging end of said laterally projecting arm, a pair of conducting wires having their upper ends connected to said socket and having insulating surface coatings extending from said socket and through said tubular bracket and downwardly through the recess in said strut, a fastening pin member projecting through the front of said strut near the top thereof and below said bracket and in spaced relation to said wires and adapted to be driven into supporting engagement with a wall, a first electrical connector block of insulating material secured in the lower end of said recess and having a pair of male contact prongs projecting from the rear of said strut and having female socket openings in its upper face opening to exposed portions of said prongs within the block, and a male connector plug having prongs electrically connected to the ends of said conducting wires and engaged in said socket openings in said first connector block.

2. An electrical fixture as defined in claim 1 in which said first connector block is secured within the recess in said strut by means of bolts passed through the body of the block in spaced relation between the electrical connections within the block.

3. An electrical fixture as defined in claim 2 in which there is a block of insulating material pressed into said recess and having spaced grooves holding said conducting wires in spaced relation to said fastening pin member.

4. An electrical fixture as defined in claim 1 in which said fastening pin member is a toggle bolt with a decorative nut on its outer end.

* * * * *